United States Patent [19]

Giacobello

[11] 4,127,944

[45] Dec. 5, 1978

[54] METHOD FOR DRYING WATER-ABSORBENT COMPOSITIONS

[75] Inventor: Bartolo J. Giacobello, Watchung, N.J.

[73] Assignee: National Starch and Chemical Corporation, Bridgewater, N.J.

[21] Appl. No.: 842,775

[22] Filed: Oct. 17, 1977

[51] Int. Cl.[2] ..... F26B 3/00
[52] U.S. Cl. ..... 34/9; 34/15
[58] Field of Search ..... 34/9, 15

[56] References Cited

U.S. PATENT DOCUMENTS

| | | | |
|---|---|---|---|
| 3,374,550 | 3/1968 | Belleau | 34/9 |
| 3,557,467 | 1/1971 | Dietert | 34/15 |
| 3,702,271 | 11/1972 | Henderson et al. | 34/9 X |
| 3,842,515 | 10/1974 | MacDonald et al. | 34/9 |
| 4,014,104 | 3/1977 | Murphy | 34/9 |

*Primary Examiner*—Leland A. Sebastian
*Attorney, Agent, or Firm*—Edwin Szala; Ellen T. Dec

[57] ABSTRACT

Improved particle agglomeration of water-absorbent compositions of matter together with improved "wet-out" and consequent absorbent properties are provided by a method for drum drying said compositions under controlled conditions.

9 Claims, No Drawings

METHOD FOR DRYING WATER-ABSORBENT COMPOSITIONS

BACKGROUND OF THE INVENTION

I. Field of the Invention

This invention relates to a method for drying water-absorbent compositions of matter to further improve their particle agglomeration, "wet-out" and consequent absorbent properties. More particularly, the invention relates to a method for drying water-swellable, water insoluble ionic complexes of a water soluble anionic polyelectrolyte and polyvalent metal cations having a valence of at least three while retaining the granular form thereof.

II. Brief Description of the Prior Art

Recently there has been a high degree of activity in the area of water-insoluble particulate hydrocolloid absorbent compositions of matter and products using the same, such as absorbent dressings, diapers, catamenial tampons, and the like for absorbing aqueous fluids such as water, urine and other aqueous body exudates. Such substantially water-insoluble compounds maintain their particular character as they imbibe and absorb many times their weight of surrounding liquid, and in doing so, swell. The compounds are capable of absoring at least 15 times their weight of fluid. In doing so, each individual absorbent particle swells or enlarges several hundred percent times its individual size without destruction of its initial particulate integrity. Each particle maintains the appoximate shape and geometry it had before contact with liquid, but the dimensions are greatly enlarged to provide for the binding of the liquid absorbed therein. As the water-insoluble compound accepts liquid, it substantially immobilizes the liquid therein, and the resulting particulate liquidswollen structure is gelatinous. The mass of swollen particulate water-insoluble particles defines an aciniform structure since each individual absorbent particle is a greatly enlarged particle, having become liquid-swollen or grape-like or acinus in form due to the liquid it has absorbed. The individual swollen particles are tacky and hence form a clustered mass of liquid-swollen particles. The particles remain in an acinus form state despite the presence of liquid in excess of their ability to absorb. The liquid-swollen particles bind their absorbed water tightly, but upon drying, they become dehydrated and return more or less to their original size. At this time they can operate more or less as before to absorb and bind liquids.

These water absorbent compositions of matter, are, however, subject to the problem variously termed in the art as lumping, poor "wet-out" or poor water dispersibility. Thus, upon exposure to the aqueous fluid to be absorbed, the absorbent compositions exhibit poor dispersibility in the aqueous medium and, at least initially, form visible clumps consisting of fluid-swollen material on the surface and relatively dry material on the inside. Expecially when used in the form of relatively fine powders, the exposed surface of the absorbent composition forms a gel-like structure which inhibits the passage of the aqueous fluid therethrough. Accordingly, the absorbent capacity of the compositions is at least initially reflective of only the absorbent capacity of the surface, and not the absorbent capacity of the interior as well. A slow rate of exposure of the absorbent composition to the aqueous medium to be absorbed, the use of relatively large granules of the absorbent composition, and agitation of the aqueous medium during exposure tend to reduce the occurrence of lumping, while agitation of the aqueous medium after exposure and the passage of time tend to dissolve lumping once it has occurred. Nonetheless, in many instances the specific application in which the absorbent composition is used precludes one or more of the aforementioned expediencies, and the need remains for an absorbent composition having improved aqueous dispersibility (i.e., better wet-out and less lumping).

U.S. Pat. No. 4,043,952, assigned to the assignee herein, teaches a method for improving the water-dispersibility of such water-absorbent (water swellable) compositions of matter by surface treating with polyvalent metal cations to ionically complex the exposed outer surface of the absorbent composition.

Although the method disclosed in the above-mentioned patent provides a dramatic improvement in the water-dispersibility or "wet-out" properties, the need for further improvement still exists. This need is particularly apparent when the water-absorbent composition is recovered and utilized in its dry form. Thus, it has been postulated that the drying operation itself may be responsible for a decrease in the wet-out and consequent water-absorption properties. It has further been observed that conventional tray drying (either with exposure to air or oven temperatures) results in a finely divided or pulverized product in contrast to the more desired granular form.

It is therefore an object of the present invention to provide a method for improving the "wet-out" properties of absorbent compositions of matter.

It is a further object to provide a method for improving "wet-out" properties while retaining the compositions in granular agglomerated form.

These and other objects will be apparent from the description which follows.

SUMMARY OF THE INVENTION

It has now been found that particle agglomeration and the "wet-out" and consequent absorbent properties of water-absorbent compositions based on anionic polyelectrolytes and surface treated in accordance with the method described in U.S. Pat. No. 4,043,952 may be synergistically improved by drum drying under controlled conditions. This improvement in wet-out is thus accomplished while maintaining the composition in granular form without the necessity for finely dividing the material so as to create more surface area but thereby producing an undesirably dusty, fine powder.

The present invention is therefore concerned with the production of a highly water-absorbent water-insoluble composition of matter comprising the steps of:

(A) forming a dispersion comprising (i) a water-swellable, water-insoluble ionic complex of a water-soluble anionic polyelectrolyte and polyvalent metal cations having a valence of at least three, (ii) polyvalent cations of at least one metal and (iii) a dispersing medium in which said composition of matter is substantially insoluble, said dispersing medium containing at least one non-aqueous liquid in which said composition is substantially insoluble;

(B) maintaining said dispersion at a temperature of about −40° C. to about +150° C. for a period of time sufficient for said cations to ionically complex the outer surface of said composition of matter exposed to said dispersing medium, and (C) separating said surface treated composition and dispersing medium.

The method of the present invention is directed to the drum drying under controlled conditions of the resultant surface treated composition. In broad description, the surface-treated composition is washed with a methanol/water (90/10) mixture and subsequently fed in slurry or cake form onto a heated drum dryer. The flaked dry product recovered from the drum surface (moisture about 2–6% by wt.) is thereafter ground or comminuted to a specified mesh size and is suitable in that form for end-use applications such as an absorbent in diapers or catamenial tampons, or storage.

DETAILED DESCRIPTION OF THE PREFERRED EMBODIMENTS

Although any water absorbent composition of matter will benefit from the specific drying method disclosed herein, the present invention is preferably directed for use with the compositions described in U.S. Pat. application Ser. No. 556,291, filed Mar. 7, 1975 now U.S. Pat. No. 4,090,013, the disclosure of which is incorporated herein by reference. In general, these compositions are formed through the polymerization and ionic complexing of one or more monomers, which monomers if homopolymerized would form a water-soluble polymer, wherein the complexing is effected with polyvalent metal cations having a valence of at least three.

The preferred polymers are the carboxylic acid homopolymers containing at least 20 mole percent carboxylic acid units, e.g., polyacrylic acid.

Exemplary of the carboxylic acid-containing polyelectrolytes are the synthetic copolymers of ethylenically unsaturated monomers with mono-ethylenically unsaturated carboxylic acids or their partially neutralized salts. Examples of the preferred $\alpha$, $\beta$-monounsaturated carboxylic acids include acrylic acid, methacrylic acid, maleic acid, maleic anhydride, itaconic acid, itaconic anhydride, fumaric acid, half esters or half amides of maleic, fumaric and itaconic acid, crotonic acid, etc. Examples of the preferred $\alpha$, $\beta$-ethylenically unsaturated monomers include acrylamide or methacrylamide and their N-alkyl and N,N-dialkyl derivatives containing 1–18 carbon alkyl groups, alkyl acrylates and methacrylates containing 1–18 carbon alkyl groups, vinyl esters, vinyl aromatic compounds, dienes, etc.

Homopolymers of monoethylenically unsaturated carboxylic acids or mixtures of these monomers may also be used. Examples include acrylic and methacrylic acid homopolymers and acrylic acid/methacrylic acid copolymers.

Exemplary of the sulfonic acid-containing poly-electrolytes are the homopolymers of nonethylenically unsaturated sulfonic acids (or salts thereof) and copolymers thereof wih the aforementioned ethylenically unsaturated monomers. Suitable sulfonate-containing monomers include aromatic sulfonic acids (such as styrene sulfonic acids, 2-vinyl-3-bromobenzenesulfonic acid, 2-vinyl-4-ethylbenzenesulfonic acid, 2-allyl benzene sulfonic acid, vinylphenylmethane-sulfonic acid and 1-sulfo-3-vinylphenylmethane sulfonic acid), heterocyclic sulfonic acids (such as 2-sulfo-4-vinylfurane and 2-sulfo-5-allylfurane), aliphatic sulfonic acids (such as ethylenesulfonic acid and 1-phenylethylene sulfonic acid), sulfonic acids containing more than a single acid radical (such as $\alpha$-sulfoacrylic acid and $\alpha$-sulfoethylenesulfonic acid), and sulfonic acid derivatives hydrolzable to the acid form (such as alkenyl sulfonic acid compounds and sulfoalkylacrylate compounds).

Exemplary of the sulfate-containing poly-electrolytes are those formed by reacting homopolymers and copolymers containing hydroxyl groups or residual polymer unsaturation with sulfur trioxide or sulfuric acid; for example, sulfated polyvinyl alcohol, sulfated hydroxyethyl acrylate, sulfated hydroxypropyl methacrylate. Exemplary of the phosphate-containing poly-electrolytes are the homopolymers and copolymers of ethylenically unsaturated monomers containing a phosphoric acid moiety, such as methacryloxy ethyl phosphate.

Exemplary of the poly-electrolytes formed of natural polymers and their derivatives are the carboxylated, sulfonated, sulfated, and phosphated derivatives of cellulose and starch, such as carboxymethyl cellulose and carboxymethyl starch. Naturally occurring anionic polyelectrolytes such as alginates, carrageenen, proteins (such as gelatin, casein, and soya protein), gum arabic, algin, agar, and gum chati also have utility.

The poly-electrolyte polymers may be prepared by conventional polymerization techniques, such as solution, emulsion, suspension, and precipitation polymerization techniques. While the polymers are preferably prepared using a free radical polymerization mechanism, other polymerization mechanisms, including anionic and cationic mechanisms, may be used. The poly-electrolyte generally has a molecular weight of from 10,000 to 10,000,000.

A polyvalent metal cation is then used to complex the poly-electrolyte to render the overall polymer composite substantially insoluble yet highly swellable in aqueous media such as water, urine, blood, etc. The cations have a valence of at least three and are cations of metals belong to the following groups of the Periodic Table: IIIB, IVB, VB, VIB, VIIB, VIII, IIIA, IVA, VA, VIA. The preferred metals are aluminum, zirconium, chromium, titanium, and iron, and to a lesser degree antimony and bismuth. Aluminum is an especially preferred metal.

The metal compound used to contribute the cation can be added prior to polymerization of the poly-electrolyte, during polymerization or post-added to a polymeric poly-electrolyte solution, the only restraint being that the metal compound be at least ionizable or soluble in the system. The polyvalent metal can be added to the composition by means of a basic, acidic or neutral salt, hydroxide, oxide or other compound or complex which has at least limited solubility in water or an organic solvent in which the poly-electrolyte and its constituent monomers are also soluble at the time of cation introduction.

Examples of inorganic salts include chlorides, nitrates, sulfates, borates, bromides, iodines, fluorides, nitrides, perchlorates, phosphates, and sulfides, such as aluminum chloride, aluminum sulfate, ferric sulfate, ferric nitrate, antimony trichloride, bismuth chloride, zirconium chloride, chromic sulfate, and chromic nitrate. Examples of organic salts include salts of carboxylic acids such as carbonates, formates, acetates, butyrates, hexanoates, adipates, citrates, lactates, oxalates, oleates, propionates, salicylates, glycinates, glycolates and tartrates; for example, aluminum formoacetate, basic aluminum acetate, chromic acetate, aluminum citrate, aluminum diformate, aluminum triformate, titanium oxalate, ferric acetate, aluminum octate, ferric oleate, zirconium lactate and zirconium acetate.

The ammonia and amine complexes (and especially those coordinated with ammonia) of these metals are particularly useful. Amines capable of so complexing include morpholine, monoethanol amine, diethylaminoethanol and ethylenediamine. Examples of these amine complexes include ammonium zirconyl carbonate, ammonium zirconyl glycinate, and ammonium chelate of nitrilotriacetic acid. Polyvalent metal complexes (salts) of organic acids that are capable of solubilization in an alkaline pH range may also be employed. Such anions as acetate, glutamate, formate, carbonate, salicylate, glycolate, octoate, benzoate, gluconate, oxalate and lactate are satisfactory. Polyvalent metal chelates wherein the ligand is a bidentate amino acid, such as glycine or alanine, are particularly useful.

Other organic compounds containing polyvalent metals are also useful; for example, the metal alkoxides, metal alkyls, and acetyl acetonates, such as aluminum isopropoxide, titanium acetyl acetonate, aluminum acetyl acetonate, chromic acetyl acetonate, zirconium ethoxide, chromic isobutoxide and triethyl aluminum.

The cations of one or more of such metals are present in the absorbent composition at a level of 0.01–5.0 milliequivalents of cation per gram of poly-electrolyte, and preferably 0.1–1.0 milliequivalents of cation per gram of poly-electrolyte. Lower cation levels do not render the polymeric composition water-insoluble, while higher cation levels render the polymer composition not only water-insoluble, but also non-swellable.

Lower cation levels within the range are especially effective when the poly-electrolyte is of relatively high molecular weight. Regardless of pH, higher cation levels within the specified range contribute to the permanency of the gel formed by exposure of the dried complex to the fluid to be absorbed; but it is noted that in many applications (e.g., diapers, tampons, etc.) a gel life of only a few hours is required and hence lower cation levels within the specified range may be suitable. In general it has been found that the optimum cation level varies with the ion size of the cation.

As will be recognized by those familiar with the art of complexing, not all of the available ionic linkages of a given polyvalent cation will necessarily be associated with different poly-electrolyte polymeric chains; especially in the case of the cations, such as zirconium, having valence or oxidation states greater than 3, inner salt formation (that is, the attachment of a single cation exclusively to a single polymer chain or to a number of polymer chains less than the valence) will occur to an unspecified degree dependent on the spatial geometries presented by the reagents involved, relative concentrations, etc. Accordingly, the specification herein of the relationship of milliequivalent weights of cation per gram of poly-electrolyte is predicated not on a theoretical basis, but rather on experimental results.

The absorbency of the composition is improved when the poly-electrolyte is at higher molecular weight levels within the specified range of 10,000 to 10,000,000. Accordingly, various di-functional monomers such as allyl methacrylate may be used to chain extend the poly-electrolyte prior to exposure to the cation. The amount of chain extender used must, of course, not render the poly-electrolyte insoluble in aqueous media. The increased chain length of the poly-electrolyte permits lower cation levels to be employed as there are fewer polymer chains to be complexed.

The absorbency of the composition is also improved when the poly-electrolyte has up to about 95%, preferably 40–85%, of its anionic groups neutralized with a suitable base such as an alkali metal hydroxide, a primary, secondary or tertiary amine, etc. The neutralization acts to uncoil and straighten out the polymer chains in aqueous fluids so that the final complex is more swellable in the presence of such fluids.

The poly-electrolytes must be substantially water-soluble at some pH between 2.0 and 8.5 to utilize the metal complexing and form the desired water-insoluble absorbent complex. However, the reversibility of ionic complexing (as opposed to covalent bonding) is well known in the chemical art and once the pH of the complex is raised above a certain level (i.e., the pH of reversibility), the complex breaks down, yielding again the water-soluble, non-absorbent poly-electrolyte. This reversibility of complex formation facilitates easy and economical application of the complex onto a desired substrate by use of conventional fluid application techniques. Prior to application a suitable quantity of a base is added to the complex to cause dissolution thereof into a solution containing the cation and the water-soluble poly-electrolyte thereof, and subsequent to application an acid is added to the solution to cause a re-formation of the absorbent complex. In a preferred technique a volatile base (such as ammonium hydroxide) is employed to break the complex so that a mere drying of the solution suffices to lower the pH and hence cause re-formation of the absorbent complex without the addition of an acid. The acid strength of the poly-electrolyte acid has a marked effect upon the pH of reversibility. The higher the acid strength (i.e., the lower the pH of dissociation), the lower the pH of reversibility. For example, polyacrylic acid, a weak polymeric acid, reverses its complex at pH 8.5–9.0 whereas styrene sulfonic acid, a very strong polymeric acid, reverses its complex at a pH of about 3.5–5.0.

The preferred composition is a polyacrylic acid-/aluminum cation complex. The aluminum cation is typically added (as aluminum acetate) during precipitation polymerization of the acrylic acid with a free radical catalyst, to provide about 0.3 milliequivalents of aluminum per gram of polymer, according to the following formulation:

| Parts by Weight | Ingredient |
|---|---|
| 73.07 | potassium acrylate |
| 27.74 | acrylic acid |
| 0.19 | allyl methacrylate |
| 1.49 | basic aluminum acetate |

Thus, the formation of a light-to-moderate network of linkages between polymer chains by ionic linkages renders the composition water-insoluble, but water-swellable. The dry absorbent composition is rendered, in the presence of a quantity of body exudate or other water-containing material, into a gelatinous agglomerate of liquid-swollen particulate members. The composition is capable of absorbing at least 15 times its weight in body exudate, and generally at least 40 times its weight. Furthermore, the composition is capable of retaining the absorbed exudate even when exposed to pressure sufficient to deform the agglomerate, and generally up to pressures of about 2.5 psi.

The absorbent capacity of the composition is independent of its physical dry form, and accordingly the composition may be used as a film, powder, or fiber. It. can be utilized as an absorbent of any aqueous fluid mixture such as water, blood or urine, and is useful in conjunction with other materials to form articles of manufacture (such as absorbent dressings, diapers, sanitary napkins, catamenial tampons, cosmetics, absorbent non-woven fabrics, and the like) as well as by itself (as an absorbent body powder, soil additive to maintain moisture, anti-perspirant, seed germination aid, pet litter additive to absorb urine, and the like). The composition may be utilized furthermore in articles of manufacture where water absorbency is not the end in and of itself, but merely a means to the end; for example, the absorbent composition may be an ingredient of tablets designed to dissolve rapidly in water or bodily fluids.

The surface treatment step employed herein is that described in U.S. Pat. No. 4,043,952, the disclosure of which is incorporated herein by reference. Thus, the polyvalent metal cations used have a valence of at least two and are cations of metals belonging to the following groups of the Periodic Table: IB, IIB, IIIB, IVB, VB, VIB, VIIB, VIII, IIA, IIIA, IVA, VA, VIA. The preferred metals are aluminum, zirconium, chromium, titanium and zinc. Aluminum is especially preferred.

The polyvalent metal compound providing the polyvalent metal cation can be added to the dispersing medium before, with or after the absorbent composition of matter. The only restraint on selection of the polyvalent metal compound is that it must be at least ionizable or soluble in the dispersing medium. Thus the polyvalent metal cations can be added to the dispersing medium by means of a basic, acidic or neutral salt, hydroxide, oxide or other compound or complex which has at least limited solubility in the dispersing medium.

Examples of suitable inorganic salts include chlorides, nitrates, sulfates, borates, bromides, iodines, fluorides, nitrides, perchlorates, phosphates, and sulfides, such as zinc chloride, barium chloride, aluminum chloride, aluminum sulfate, ferric sulfate, ferric nitrate, antimony trichloride, bismuth chloride, zirconium chloride, chromic sulfate, and chromic nitrate. Examples of suitable organic salts include salts of carboxylic acids such as carbonates, formates, acetates, butyrates, hexanoates, adipates, citrates, lactates, oxalates, oleates, propionates, salicylates, glycinates, glycolates and tartrates; for example, zinc acetate, chromium acetate, aluminum formoacetate, basic aluminum acetate, chromic acetate, aluminum citrate, aluminum diformate, aluminum triformate, titanium oxalate, ferric acetate, aluminum octate, ferric oleate, zirconium lactate and zirconium acetate. Basic aluminum acetate is a preferred organic salt.

The ammonia and amine complexes (and especially those coordinated with ammonia) of these metals are particularly useful. Amines capable of so complexing include morpholine, monoethanol amine, diethylaminoethanol and ethylenediamine. Examples of these amine complexes include ammonium zirconyl carbonate, ammonium zirconyl glycinate, and ammonium zirconium chelate of nitrilotriacetic acid. Polyvalent metal complexes (salts) or organic acids that are capable of solubilization in the dispersing medium may also be employed. Such anions as acetate, glutamate, formate, carbonate, salicylate, glycolate, octoate, benzoate, gluconate, oxalate and lactate are satisfactory. Polyvalent metal chelates wherein the ligand is a bidentate amino acid, such as glycine or alanine, are particularly useful.

Other organic compounds containing polyvalent metals are also useful; for example, the metal alkoxides, metal alkyls, and acetyl acetonates, such as aluminum isopropoxide, titanium acetyl acetonate, aluminum acetyl acetonate, chromic acetyl acetonate, zirconium ethoxide, chromic isobutoxide and triethyl aluminum.

The cations of one or more of such metals are present in the dispersion at a level of 0.05–10.0 milliequivalent of cation per gram of the absorbent composition of matter on a dry basis, and preferably 0.1–2.0 milliequivalents of cation per gram. In general, the finer the particle form of the dry absorbent composition, the more cation should be employed.

The choice of dispersing medium is not critical, providing only that the absorbent composition of matter is substantially insoluble therein. Of course, as pointed out above, the compound used to introduce the polyvalent metal cation into the dispersion must also be ionizable or soluble in the dispersing medium. The dispersing medium is preferably one or more of the following liquids in which the dry absorbent composition of matter is substantially insoluble: aliphatic or aromatic alcohols containing 1 to 18 carbon atoms (such as methanol, ethanol, isopropanol, 2 ethyl hexanol, benzyl alcohol, etc.), ketones (such as acetone, methyl ethyl ketone, etc.), alkyl ethers (such as ethyl ether, etc.), aliphatic and aromatic esters (such as ethyl acetate, butyl propionate, etc.), alkanes containing 5 to 18 carbon atoms (such as hexane, heptane, etc.), aromatics (such as benzene, toluene, etc.), blends of water-miscible solvents (such as lower alkyl ketones and alcohols, dioxane, dimethyl formamide, etc.) with water. Other solvents such as dimethyl sulfoxide and tetrahydrofuran also have utility.

The dispersing medium is typically (but not necessarily) used at a level of about 0.5 to 100 parts, and preferably about 2–10 parts, per part by weight of the absorbent composition of matter on a dry basis.

TREATMENT OF THE DISPERSION

Once the dispersion is formed, it is maintained for a period of time sufficient to permit the polyvalent metal cation to ionically complex the surface of the absorbent composition of matter (and more particularly the anionic poly-electrolyte thereof). In general, a moderate level of ionic complexing at the surface is desired. If the level of surface complexing is either too light or too heavy, no improvement in water-dispersibility is gained. The optimum level of surface complexing may easily be determined for a given poly-electrolyte and given cation set by plotting the dispersibility and/or full dispersion time as a function of various levels of surface cross-linking. The amount of time required will naturally depend both upon the degree of complexing desired and the temperature at which the dispersion is maintained. Generally, the temperature is maintained within the range of from −40° C. to +150° C., preferably from 25° C. to 100° C. At these temperatures, suitable complexing is achieved in a period of time from about one minute to several hours, and preferably from five minutes to one hour.

After the desired degree of complexing has occurred, the modified composition and the dispersing medium are separated by conventional techniques, for example, by evaporation of the dispersing medium or by filtration.

DRYING METHOD

The present method contemplates the drying of the waterabsorbent composition by feeding a defined slurry of the material onto a heated drum dryer of the single, the double roll, or twin drum type. As already mentioned, the method preferably utilizes the surface treated water-absorbent composition obtained as described above, but it can be understood that the untreated composition could likewise be used in similar manner. Preferably, the composition, whether treated or not, would be washed at least once with a methanol/water (approximately 90/10)mixture and separated into a wet cake containing about 50% solids.

The cake comprising the water-absorbent composition is thereafter diluted with additional water and methanol as necessary to provide a slurry having a solids content of approximately 25%, by weight, although the solids content is not critical and conveniently may range from 20 to 35% by weight. Of more importance is the ratio of water to solids, and for purposes of this method, it has been found necessary to adjust the slurry with water (and methanol) to yield a water on solids content, expressed in wt. percent, of from 15 to 85%, with 25 to 75% preferred. Use of a slurry within the above parameters tends to maximize particle agglomeration yielding lesser amount of dust fines by grinding the dry flakes. Likewise, the absorbent property of the resultant compositions is improved as compared to compositions dried from slurries falling outside the specified parameters.

As an illustrative calculation, if 1,000 gms. of a slurry having a 25% solids and 30% water on solids concentration is desired, one begins by taking 500 gms. of wet cake of the washed absorbent composition which ordinarily is 50% solids, 45% methanol and 5% water, all on a weight basis. (It is assumed that where the cake is not precisely at 50.0% solids, and the methanol/water mixture is not 90/10, obvious adjustments in the calculations would be made.) The 500 gms. of wet cake would yield 250 gms. of solids, and 225 gms. of methanol and 25 gms. of water. Since water on solids is set to equal 30%, the slurry would necessarily contain 75 gms. of water, and an additional 50 gms. of water would be needed. Moreover, 450 gms. of methanol would be added (in addition to the 225 gms. already present) to yield 1,000 gms. of the final slurry.

While methanol is the preferred alcohol for use in the wash mixture, slurry, etc., it is also possible to utilize other water-miscible alcohols, for example, ethanol, isopropanol, propanol, and butanol, throughout the method in place of methanol. Mixtures of such alcohols are likewise useful.

In accordance with the invention, the slurry is thereafter fed onto a single, double or twin drum dryer where the temperature is preferably maintained at 300°-350° F. Temperatures as low as about 250° F. and as high as 380° F. may be used, however. The drum revolutions (revolutions per minute) are varied as necessary, slowed with low temperatures and speeded with high temperatures, in order that the composition is given sufficient residence time to dry to the approximately 2-6% moisture level ordinarily desired. The distance between the rollers of the twin drums (or the nip feed in the case of a single roll) may be adjusted as necessary to produce a film thickness of about 10 to 100 mils. Those skilled in the art will need a minimum of experimentation to provide the necessary adjustments in the opening, feed rate and roll temperature to provide a suitably dried composition.

In a variation of the method herein, it is also possible to utilize wet cake in feeding the drum dryer. Ordinarily, the wet cake fed on to the drum dryer will contain from about 36-55% solids with the liquid component constituting a methanol/water mixture. The wet cake should have a water on solids ratio of from 15 to 50% and from 20 to 40% preferably. The cake is prepared for use by appropriate selection of the methanol/water mixture containing the necessary amount of water. The drum temperatures using the wet cake feed are essentially as described for the slurry feed but minor adjustments in drum revolutions and gap separations may be necessary.

The temperature, drum speed, etc. are adjusted as necessary to produce the dried absorbent composition containing from about 2-6% volatiles (moisture) by wt. It is to be understood that the invention is likewise operable to effect drying of the composition such that it contains essentially no moisture ranging to a moisture level of 12 or 14%. The dried flaked material is recovered from the drum surface in conventional manner. In sieving of the collected material it is found that at least approximately 35% possesses a particle size of from <30 to >200 mesh sieves (USSS). The latter particle size range has been found to be most effective in effecting the polymer absorbent under generally used conditions. The remaining coarse particles are comminuted or ground to a particle size within the mentioned range while the particles (fines) are ordinarily discarded because of difficulties connected in their handling.

As a still further variation in the drying method the drum dryer may be enclosed in vacuum chamber where the actual drying is carried out under reduced pressures. Such variation will ordinarily hasten the drying process and in some instances lead to still further improved agglomeration of the dried product with consequent production of less fines while maintaining high absorbent properties.

EXAMPLES

The following examples illustrate the method of the invention and also show the improved results obtained by such practice.

EXAMPLE I

1120 Grams of washed wet filter cake containing 50% absorbent polyelectrolyte (total basic aluminum acetate 2.5% based on starting monomer), 9% water and 41% methanol were suspended in 784 gms. of methanol and 96 gms. of water to obtain a slurry at 28% solids and 35% water on solids. The slurry was dried on a double drum dryer running at 5 rpm with a 9.0-11 mil separation between the drums and having a surface temperature of 340°-345° F. The dried product was obtained in the form of flakes which were sifted on 30 and 200 mesh sieves (USSS). About 80% of the flakes were already in the desired <30 to >200 mesh range. The coarse fraction (>30 mesh) was milled and rescreened twice in order to reduce the amount of coarse material to a negligible amount. In total, 93% of the original flakes were thus obtained as product having a particle size in the <30 to >200 mesh range, with the balance in the form of fines (<200 mesh). The agglomerated product had a volatile (moisture) content of 4.3% and absorbed 10 times its weight of synthetic urine in 17 seconds, 32 times its weight of synthetic urine in 500 seconds and 33 times its weight of synthetic urine at equilibrium.

EXAMPLE II (Comparison)

When the washed wet cake of Example I (18% water on solids) was screened through 8 mesh and tray dried in one-inch layers at 260°-270° F. to a moisture content of about 5.0%, a dried product with many lumps was obtained. Only 40% of the product was in the desired <30 to >200 mesh range, and 33% was obtained as fines (<200 mesh). The coarse, hard lumps had to be milled and rescreened five times in order to reduce this coarse fraction to a negligible amount. After combining the ground material with the original "as is" material having the desired particle size, only 61% of the total dried product was within the desired <30 to >200 mesh range. In addition, the product thus obtained had markedly inferior absorbency characteristics when compared to the product in Example I. It required 110 seconds to absorb 10 times its weight of synthetic urine and at equilibrium had absorbed only 25 times its weight.

EXAMPLE III (Comparison)

When 7.5 lbs. of the washed wet cake from Example I was resuspended in 7.5 lbs. of a solvent consisting of 80% methanol and 20% water and centrifuged, a cake at 45% solids and 13.4% water was obtained. Thus the water/solids ratio was raised to 30% in order to increase agglomeration during drying. When this wet cake was tray dried, (moisture level about 5.0%), screened and milled in the manner described in Example II, 88% of the original dry product was obtained in the <30 to >200 range. However, the absorbent properties were again markedly inferior compared to the drum dried product: 40 seconds to absorb 10 times its weight of synthetic urine and only 25 times its weight had been absorbed at equilibrium.

EXAMPLE IV (Comparison)

When 1500 grams of the washed wet cake from Example I was resuspended in 1500 grams of 75/25 methanol/water and vacuum filtered, a filter cake was obtained that now consisted of 42% solids, 17.3% water and 40.7% methanol. The ratio of water to solids was 41.2%. Three hundred grams of the fresh cake were dried for 15 minutes on a laboratory forced circulation hot air tray dryer with the air temperature maintained at 350° F. Forty-nine percent of the product as obtained from the dryer was in the desired <30 to >200 mesh range and 47% was in the form of hard lumps measuring >30 mesh. These lumps required four mill passes in order to reduce them to a negligible amount. When the materials of <30 to >200 mesh were combined, 90% of the original dried product was recovered as usable product, but the absorbent properties of this product were inferior to the product obtained from Example In in that it absorbed only 26 times its weight of synthetic urine at equilibrium.

EXAMPLE V

1102 Gms. of a washed filter cake containing 50.8% absorbent polyelectrolyte (total basic aluminum acetate 5.0% based on starting monomer), 10.5% water and 38.7% methanol were suspended in 818 gms. of methanol and 80 gms. of water to obtain a slurry at 28% solids and 35% water on solids. The slurry was drum dried, screened and milled as described in Example I. Eighty-five percent of the flakes as obtained from the drum were already in the desired <30 to >200 mesh range. The coarse fraction required two millings in order to reduce the coarse fraction to a negligible amount. After combining the ground material with the original "as is" flakes (<30 to >200 mesh), a total of 93% of the total flakes was within the desired mesh range. The agglomerated product had a volatiles content of 4.6% and absorbed 10 times its weight of synthetic urine in 12 seconds and 30 times its weight of synthetic urine at equilibrium.

EXAMPLE VI (Comparison)

When 1500 gms. of the wet cake of Example V was resuspended in 1500 grams of 75/25 methanol/water and vacuum filtered, it now was composed of 45% solids, 16.8% water and 38.2% methanol. The ratio of water to solids was 37.3%. About 300 gms. of the fresh cake was dried for 15 minutes on a laboratory forced circulation hot air tray dryer with the air temperature maintained at 350° F. Forty-six percent of the product obtained from the dryer was in the <30 to >200 mesh range and 49% was in the form of hard lumps (>30 mesh). These lumps required six mill passes in order to reduce them to a negligible amount. When the <30 to >200 mesh materials were combined, 87% of the original dried product has been recovered in the desired mesh range. Although almost as much agglomerated product in the desired <30 to >200 mesh range was produced as was produced with the drum dryer, the tray dried product had much inferior absorbency characteristics in that it absorbed only 24 times its weight of synthetic urine at equilibrium.

EXAMPLE VII

The wet cake of Example III, (washed with 80/20 methanol water) at 45% solids, 13.4% water and 30% water on solids was drum dried on a double roll drum at 15 rpm with a 5 mil gap and a surface temperature of 340°-345° F. Of the dry product obtained, 31% was in the form of flakes in the >30 to >200 mesh range and 65% was >30 mesh. The coarse fraction required 3 mill passes in order to reduce the coarse to a negligible amount. A total of 83% of the total dry product was thus obtained in the desired >30 to <200 mesh range. The blended product absorbed 10 times its weight of synthetic urine in 13 seconds and 33 times its weight at equilibrium.

EXAMPLE VIII

A wet cake composed of absorbent polyelectrolyte (3% total basic aluminum acetate based on starting monomer), methanol and water was resuspended in suitable amounts of methanol and water to obtain a slurry at 30.1% solids and 41.5% water on solids. When the above slurry was pumped to the nip of a double drum dryer contained within a sealed chamber wherein the pressure was maintained at 16.5 inches of mercury and the dryer was operated at a speed of 6 rpm with a separation between the drums of 12 mils and an internal steam pressure of 23 psig (about 255° F.), a dry product was obtained in the form of flakes. The dried flakes had 43% of their weight in >30 to <200 mesh range and 52% was >30 mesh. After milling and sieving the coarse fraction and combining it with the "as is" product, a final blend was obtained that absorbed 11 times its weight of synthetic urine in 11 seconds and 32 times its weight at equilibrium.

In summary, a method of drum drying liquid absorbent compositions is provided which method provides improved particle agglomeration while maintaining high absorbent properties of the dried material. The occurrence of lumping in the dried product is particularly severe in drying methods using static or rotary tray dryers, jacketed rotary and fluid bed dryers. In these type of dryers a substantial portion of the product is obtained in the form of hard lumps (which necessarily must be milled) and the end product possesses reduced absorbency properties. Thus not only does the formation of these lumps reduce the surface area available for drying (and prolong the drying time) but the lumped material when milled invariably shows a reduction of absorbency when compared to material which did not lump during drying. Attempts to dry the absorbent product in the above dryers from a wet cake containing lesser amounts of water (so as to minimize lumping) is also unsuccessful mainly in producing increased amounts of dust or fines. No means for agglomerating the dust or fines so obtained has been shown to be acceptable.

I claim:

1. A method for drying a water-absorbent composition comprising the steps of:

(a) forming a slurry or wet cake of said composition with water and a water-miscible alcohol such that the slurry contains from 20 to 35% solids, by weight, and from 15 to 85% water on solids, by weight, and the wet cake contains 36 to 55% solids, by weight, and from 15 to 50% water on solids, by weight;

(b) feeding the slurry or wet cake onto a heated drum dryer having a surface temperature of 250° to 380° F. at a rate to produce a film of from 10 to 100 mils in thickness;

(c) recovering the dried product in flake form from the drum surface, whereby the dried product is obtained in granular, agglomerated form and has improved water dispersibility and absorbent properties.

2. The method of claim 1 wherein the water-miscible alcohol employed in step (a) is selected from the group consisting of methanol, ethanol, propanol, isopropanol and butanol.

3. The method of claim 1 wherein the water-miscible alcohol employed in step (a) is methanol and the slurry contains from 25 to 75% water on solids, by weight, and the composition is a water-swellable, water insoluble complex of an anionic polyelectrolyte and polyvalent metal cations having a valence of at least 3.

4. The method of claim 3 wherein the surface temperature of the drum dryer is from 300°-350° F.

5. The method of claim 1 wherein the water-miscible alcohol employed in step (a) is methanol and the wet cake contains from 20 to 40% water on solids, by weight, and the composition is a water-swellable, water insoluble complex of an anionic polyelectrolyte and polvalent metal cations having a valence of at least 3.

6. The method of claim 5 wherein the surface temperature of the drum dryer is from 300°-350° F.

7. The method of claim 1 wherein step (b) is carried out in a vacuum chamber under reduced pressure.

8. The method of claim 1 where the composition is dried to a moisture content of less than about 14%, by weight.

9. The method of claim 4 wherein the composition is dried to a moisture content of from about 2-6%, by weight.

* * * * *

UNITED STATES PATENT OFFICE

CERTIFICATE OF CORRECTION

Patent No. 4,127,944 Dated December 5, 1978

Inventor(s) Bartolo J. Giacobello

It is certified that error appears in the above-identified patent and that said Letters Patent are hereby corrected as shown below:

Column 1, line 26, "absoring" should read -- absorbing --; line 31, "appoximate" should read -- approximate --; line 36, "liquidswollen" should read -- liquid-swollen --. Col. 3, line 56, "wih" should read -- with --; line 68, "hydrolzable" should read -- hydrolizable --. Col. 4, line 36, "belong" should read -- belonging --; line 55, "iodines" should read -- iodides --. Col. 6, line 67, "It." should read -- It --. Col. 7, line 34, "iodines" should read -- iodides --. Col. 8, line 20, "2 ethyl hexanol" should read -- 2-ethylhexanol --; line 66, "waterabsorbent" should read -- water-absorbent --. Col. 11, line 51, "In" should read -- I --. Col. 12, line 35, " >30" should read

UNITED STATES PATENT OFFICE

CERTIFICATE OF CORRECTION

Patent No. 4,127,944 Dated December 5, 1978

Inventor(s) Bartolo J. Giacobello

It is certified that error appears in the above-identified patent and that said Letters Patent are hereby corrected as shown below:

-- <30 --; lines 39 and 57, " >30 to <200" should read --

-- <30 to >200 --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*